US009074408B2

(12) United States Patent
Sung

(10) Patent No.: US 9,074,408 B2
(45) Date of Patent: Jul. 7, 2015

(54) WINDOW ASSEMBLY AND CONSTRUCTION MODULE ASSEMBLY USING THERMOBIMETALS

(71) Applicant: UNIVERSITY OF SOUTHERN CALIFORNIA, Los Angeles, CA (US)

(72) Inventor: Doris Sung, Rolling Hills, CA (US)

(73) Assignee: UNIVERSITY OF SOUTHERN CALIFORNIA, Los Angeles, CA (US)

( * ) Notice: Subject to any disclaimer, the term of this patent is extended or adjusted under 35 U.S.C. 154(b) by 78 days.

(21) Appl. No.: 13/911,173

(22) Filed: Jun. 6, 2013

(65) Prior Publication Data

US 2013/0326974 A1 Dec. 12, 2013

Related U.S. Application Data

(60) Provisional application No. 61/656,084, filed on Jun. 6, 2012, provisional application No. 61/726,525, filed on Nov. 14, 2012.

(51) Int. Cl.

| | |
|---|---|
| ***E06B 7/00*** | (2006.01) |
| ***E06B 9/24*** | (2006.01) |
| ***E06B 7/02*** | (2006.01) |
| ***E06B 3/67*** | (2006.01) |

(52) U.S. Cl.

CPC ... *E06B 9/24* (2013.01); *E06B 7/02* (2013.01); *E06B 3/6722* (2013.01); *E06B 2009/2417* (2013.01)

(58) Field of Classification Search

CPC ..... E06B 3/6722; E06B 7/02; E06B 9/24; E06B 2009/2417

USPC ..... 52/171.3, 204.5, 204.59, 204.593, 52/204.599, 209, 573.1; 47/17

See application file for complete search history.

(56) References Cited

U.S. PATENT DOCUMENTS

| | | | | |
|---|---|---|---|---|
| 2,625,640 | A * | 1/1953 | Gaiser et al. | 219/522 |
| 6,105,318 | A * | 8/2000 | Harrison | 52/200 |
| 6,408,289 | B1 * | 6/2002 | Daum | 706/45 |
| 6,446,402 | B1 * | 9/2002 | Byker et al. | 52/173.3 |
| 7,817,328 | B2 * | 10/2010 | Millett et al. | 359/288 |
| 8,096,506 | B2 * | 1/2012 | Bold | 244/129.3 |
| 8,154,788 | B2 * | 4/2012 | Millett et al. | 359/288 |
| 8,230,649 | B2 * | 7/2012 | Kapany | 52/171.3 |
| 2003/0041538 | A1 * | 3/2003 | Ting | 52/204.5 |
| 2011/0258921 | A1 * | 10/2011 | Rotter | 47/17 |
| 2012/0279147 | A1 * | 11/2012 | Kapany | 52/171.3 |
| 2013/0008101 | A1 * | 1/2013 | Marchand | 52/173.1 |
| 2013/0091792 | A1 * | 4/2013 | Fujimoto | 52/302.1 |

* cited by examiner

*Primary Examiner* — Jeanette E Chapman
*Assistant Examiner* — James Buckle, Jr.
(74) *Attorney, Agent, or Firm* — Michael Best & Friedrich LLP

(57) ABSTRACT

A window assembly includes a pane of material through which light is passable and a plurality of thermobimetal elements positioned adjacent the pane. The elements each assume a first shape at a first temperature and a second shape at a second temperature. The elements reflect more light away from the pane when in the second shape than the first shape.

20 Claims, 10 Drawing Sheets

FIG. 1c

WINDOW ASSEMBLY AND CONSTRUCTION MODULE ASSEMBLY USING THERMOBIMETALS

CROSS-REFERENCE TO RELATED APPLICATIONS

This application claims priority to U.S. Provisional Patent Application Nos. 61/656,084 filed Jun. 6, 2012 and 61/726,525 filed Nov. 14, 2012, the entire contents of both of which are incorporated herein by reference.

FIELD OF THE INVENTION

The present invention relates to window and construction module assemblies, and more particularly to window and construction module assemblies utilizing thermobimetal elements.

BACKGROUND OF THE INVENTION

Commercial and residential buildings are typically artificially conditioned to provide a consistent and comfortable internal temperature to occupants of the building. Artificial conditioning often includes cooling or ventilating the building when the building is exposed to increased sunlight and/or temperature. Conventional means of cooling or ventilating buildings typically consume energy and require human interaction or an electronic control system.

SUMMARY OF THE INVENTION

The present invention provides, in one aspect, a window assembly including a pane of material through which light is passable and a plurality of thermobimetal elements positioned adjacent the pane. The elements each assume a first shape at a first temperature and a second shape at a second temperature. The elements reflect more light away from the pane when in the second shape than the first shape.

The present invention provides, in another aspect, a construction module assembly including a construction module having a first side and a second side, and a passageway through the module. The construction module assembly also includes a thermobimetal valve coupled to the module. The valve assumes a first shape at a first temperature for blocking airflow through the passageway, and a second shape at a second temperature for permitting airflow through the passageway.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1A:
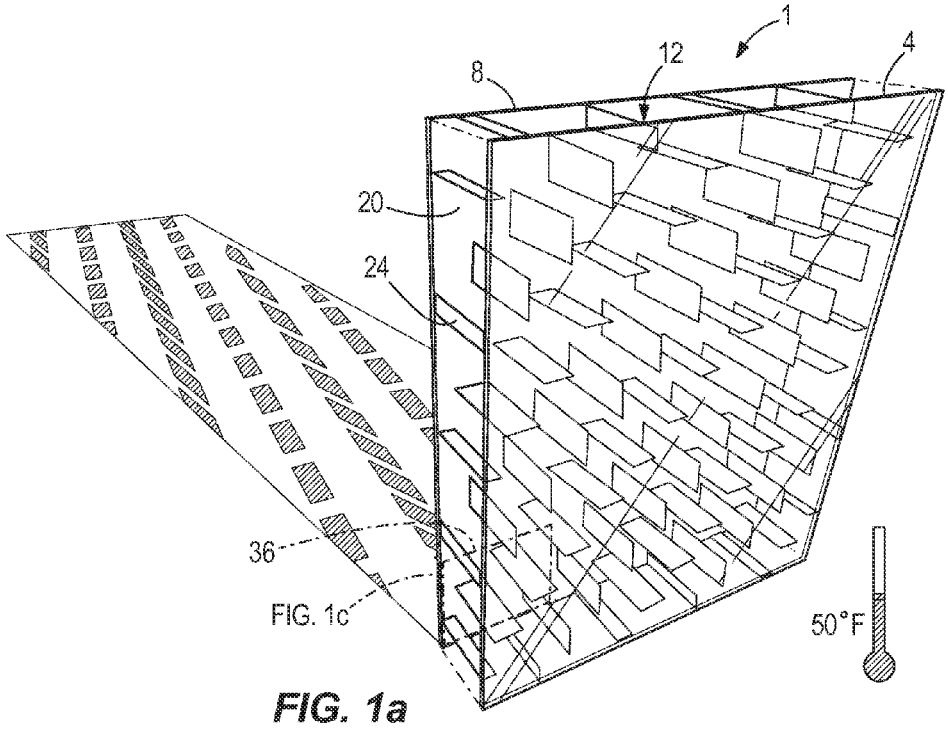
FIG. 1*a* is a perspective view of a window assembly in accordance with a first embodiment of the invention.
Figure 2A:
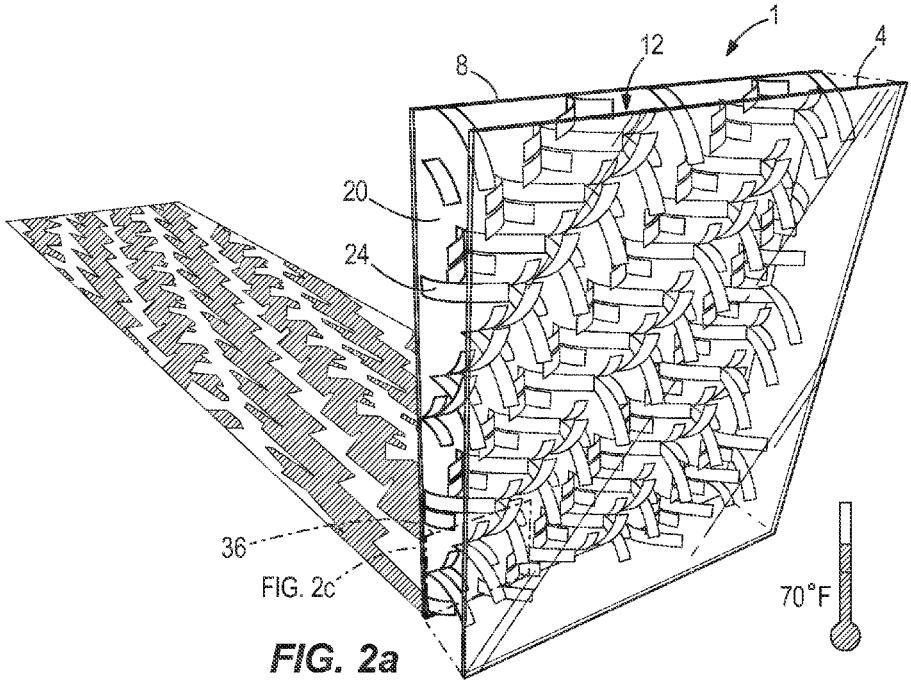
FIG. 2*a* is another perspective view of the window assembly of FIG. 1*a* exposed to a higher temperature.
Figure 3A:
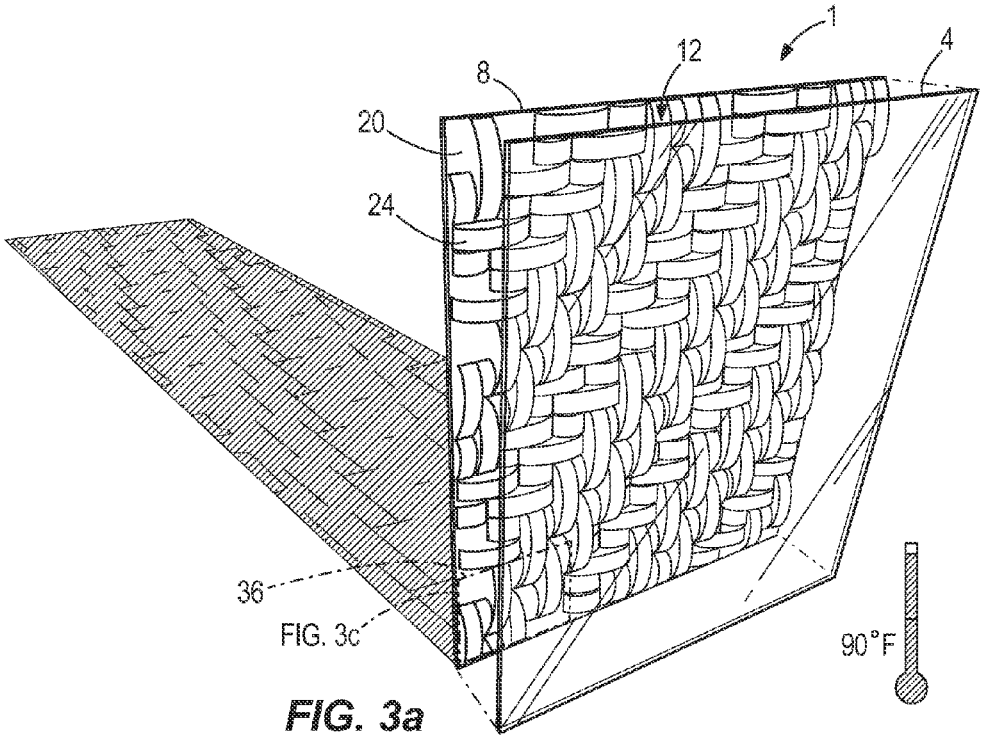
FIG. 3*a* is yet another perspective view of the window assembly of FIG. 1*a* exposed to a higher temperature.

FIGS. 1*a*, 2*a*, and 3*a* illustrate a window assembly 1 for use in a building (e.g., a commercial or residential building, etc.). As used herein, "window assembly" is intended to cover, for example, double pane windows and glass blocks for use in commercial or residential buildings, and a double-skin façade (e.g., box, shaft, corridor, or complete double-skin façades) for use in large commercial buildings. The window assembly 1 includes opposed, first and second panes or skins 4, 8 through which light is passable. Particularly, each of the panes 4, 8 is transparent and may be made of any of a number of different materials exhibiting transparency (e.g., glass, plastic, etc.). As shown in FIGS. 1*a*, 2*a*, and 3*a*, each of the panes 4, 8 has a square shape; however, the panes 4, 8 may be configured having any number of shapes (e.g., rectangular, circular, polygonal, etc.) depending upon the particular application of the window assembly 1.

The window assembly 1 also includes a frame 10 (FIG. 1*b*) to which the panes 4, 8 are mounted, thereby defining a chamber 12 between the panes 4, 8. The frame 10 can be made of any number of materials, for example, wood, plastic, or metal. The panes 4, 8 have respective inner surfaces 16, 20 that are spaced apart and in facing relationship with each other (FIGS. 1*a*, 2*a*, and 3*a*). Accordingly, the inner surfaces 16, 20 of the respective panes 4, 8 at least partially define the chamber 12. The spacing between the panes 4, 8, and therefore the width of the chamber 12, may be dictated by the particular application of the window assembly 1. For example, the chamber 12 may have a width typically associated with chambers found in double pane windows (e.g., about 0.25 inches), double-skin facades (e.g., about 3 inches to about 3 feet), and glass blocks (e.g., about 3 inches). Likewise, the panes 4, 8 may be configured having any number of thicknesses. The thickness of the panes 4, 8 may be dictated by the particular application of the window assembly 1. For example, the panes 4, 8 may have a thickness typically associated with the thickness of individual panes or layers of double pane windows, double-skin facades, and glass blocks. In some embodiments, additional panes may be included in the window assembly 1 to at least partially define additional chambers, for example, a triple pane window having three panes that define two chambers or a quadruple pane window having four panes that define three chambers. In other embodiments, the chamber 12 may be sealed, thereby preventing access to the chamber 12, while in still other embodiments, the chamber 12 may be accessible. Such an accessible chamber may be utilized, for example, in a double-skin façade, thereby allowing for maintenance of the double-skin façade and insulation.

Figure 1B:
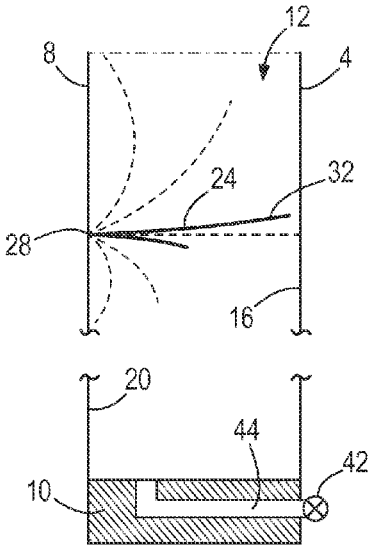
FIG. 1*b* is a cross-sectional view of the window assembly of FIG. 1*a*.
Figure 1C:
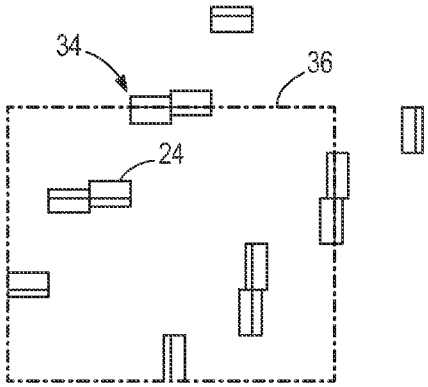
FIG. 1*c* is an enlarged view of the window assembly of FIG. 1*a*.
Figure 2C:
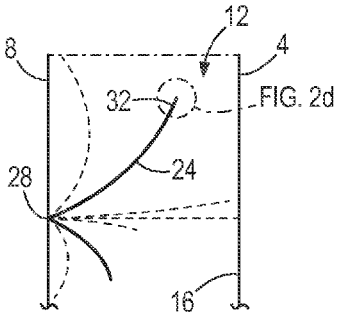
FIG. 2*c* is an enlarged view of the window assembly of FIG. 2*a*.
Figure 2C:
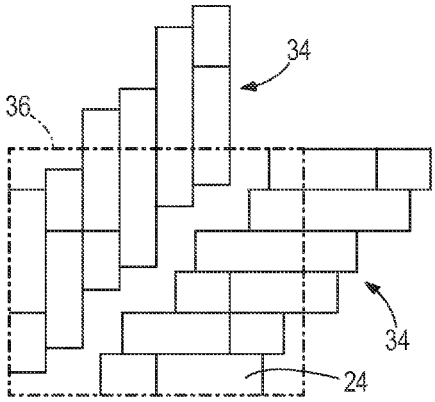
Figure 2B:
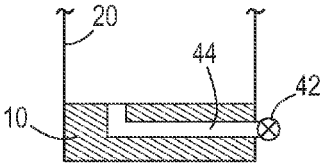
FIG. 2*b* is a cross-sectional view of the window assembly of FIG. 2*a*.
Figure 3B:
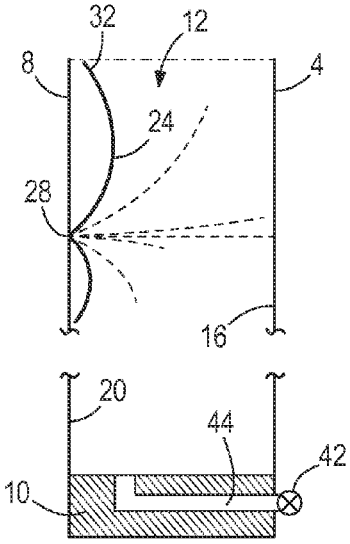
FIG. 3*b* is a cross-sectional view of the window assembly of FIG. 3*a*.
Figure 3C:
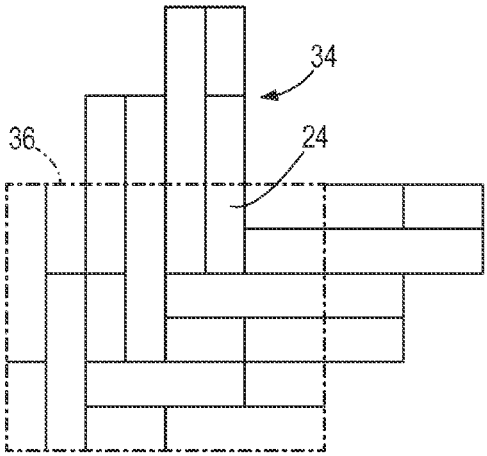
FIG. 3*c* is an enlarged view of the window assembly of FIG. 3*a*.

With continued reference to FIGS. 1*a*, 2*a*, and 3*a*, the window assembly 1 further includes thermobimetal elements 24 positioned within the chamber 12. Each thermobimetal element 24 includes first and second ends 28, 32, with the first end 28 of each thermobimetal element 24 being attached to the inner surface 20 of the pane 8 (FIGS. 1*b*, 2*b*, and 3*b*). The second or distal end 32 of each thermobimetal element 24 is not attached to either of the inner surfaces 16, 20 of the respective panes 4, 8. The thermobimetal elements 24 are also diagonally arranged in substantially identical groups 34, one or more groups 34 being associated with a particular region 36 of the panes 4, 8 (FIGS. 1*c*, 2*c*, and 3*c*). Alternatively, the thermobimetal elements 24 may be arranged in any number of patterns or configurations (e.g., circular, rectangular, polygonal, etc.). In still other alternative embodiments, the thermobimetal elements 24 may be positioned within the chamber 12 and suspended between the panes 4, 8 by another structure without being directly supported by the panes 4, 8.

Figure 2D:
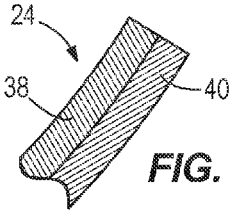
FIG. 2*d* is an enlarged view of a thermobimetal element of the window assembly of FIG. 2*a*.

Each thermobimetal element 24 is made of a first sheet 38 coupled (e.g., by lamination, adhesion, etc.) to a second sheet 40 in which the first and second sheets 38, 40 include first and second metal alloys, respectively (FIG. 2*d*). Particularly, each of the first and second sheets 38, 40 is a continuous sheet, and therefore, the thermobimetal element 24 is opaque. In alternative embodiments, the first and second sheets 38, 40 may be perforated or porous, and therefore, some light may pass through the perforations of the thermobimetal element 24 in a manner similar to a mesh screen. The first and second metal alloys have different coefficients of thermal expansion and as such, the first and second sheets 38, 40 expand at different rates as heat is applied to the thermobimetal elements 24, causing each thermobimetal element 24 to transition (e.g., curl) from a first shape (FIG. 1*b*) to a second shape (FIGS. 2*b* and 3*b*). In turn, as heat is removed from the thermobimetal elements 24, the elements 24 transition from the second shape to the first shape. In the first shape, for example, the thermobimetal element 24 is substantially straight and oriented normal to the panes 4, 8 (FIG. 1*b*). In the second shape, the thermobimetal element 24 has an arcuate shape (FIGS. 2*b* and 3*b*). As the thermobimetal elements 24 transition between the first and second shapes, the first end 28 of each respective thermobimetal element 24 is constrained because it is attached to the pane 8, but the second end 32 of each respective thermobimetal element 24 is movable relative to the panes 4, 8.

With continued reference to FIGS. 1*b*, 2*b*, and 3*b*, the window assembly 1 may include one or more thermobimetal valves 42 mounted along a perimeter of the frame 10 and corresponding passageways 44 in the frame 10 communicating the chamber 12 and the surrounding environment of the window assembly 1. Each thermobimetal valve 42, like the thermobimetal elements 24, has a first sheet of a first metal alloy laminated to a second sheet of a second metal alloy, and transitions from a first shape (i.e., straight) to a second shape (i.e., arcuate) as the temperature increases and back again to the first shape as the temperature decreases. The thermobimetal valve 42 may be configured such that when in the second shape (i.e., when heated), the valve closes the passageway 44 and prevents air from entering and exiting the chamber 12, and when in the first shape (i.e., when cooled), the valve 42 opens the passageway 44 to enable movement of air though the passageway 44 to cool the chamber 12, and therefore the interior of the building in which the window assembly 1 is incorporated. In an alternative construction of the window assembly 1, the thermobimetal valve 42 may be replaced with a conventional valve (e.g., a plunger, etc.) that is movable by a thermobimetal actuator to open and close the passageway 44.

With reference to FIGS. 1*a*, 2*a*, and 3*a*, the window assembly 1 is operable independently of a user. In periods of low sunlight and thus lower temperatures (e.g., 50 degrees Fahrenheit; FIG. 1*a*), each of the thermobimetal elements 24 assumes the first shape (i.e., straight) and sunlight is allowed to pass through the panes 4, 8 and into the building. As the window assembly 1 is exposed to increasing sunlight and thus higher temperatures (e.g., 70 degrees Fahrenheit and 90 degrees Fahrenheit; FIGS. 2*a* and 3*a*, respectively), the thermobimetal elements 24 assume the second shape (i.e., arcuate) and a reduced amount of sunlight is allowed to pass through the pane 8 and into the building because more light is reflected away from the window assembly 1 when the thermobimetal elements 24 assume the second shape as compared to the first shape. Accordingly, the pane 8, and therefore, an interior of the building are more shaded when thermobimetal elements 24 assume the second shape as compared to the first shape because the curled elements 24 prevent or block more light from reaching the pane 8 and the building interior. In other words, the window assembly 1 is substantially transparent when the thermobimetal elements 24 assume the first shape (FIG. 1*a*), but is substantially opaque when the thermobimetal elements 24 assume the second shape (FIGS. 2*a* and 3*a*). By transitioning the thermobimetal elements 24 between the first and second shapes during respective periods of decreased and increased sunlight and temperature, sun shading is automatically provided to the building as needed without requiring human interaction or an electronic control system. As such, the internal temperature of the building may remain more consistent while concurrently reducing the need for artificial cooling of the building and the attendant energy consumption for cooling the building as compared to a building having conventional single or multi-pane windows.

The window assembly 1 is also operable to provide cooling at night. At night, when temperatures are lower, the one or more thermobimetal valves 42 adopt the first shape (i.e., straight) and the corresponding passageways 44 are open, permitting cooler night-time air to exit and enter the chamber 12. However, during the daytime when temperatures are higher, the thermobimetal valves 42 adopt the second shape (i.e., arcuate) and block the corresponding passageways 44 in the frame, preventing the exchange of air between the chamber 12 and the surrounding exterior environment. By allowing air movement between the chamber 12 and the surrounding exterior environment during cooler periods (e.g., night-time), the chamber 12 of the window assembly 1 may be cooled and thus the building without requiring human interaction or an electronic control system. As such, the need for artificial cooling of the building and the attendant energy consumption for cooling the building may be reduced compared to a building having conventional single or multi-pane windows. In alternative embodiments, the thermobimetal valve 42 and passageway 44 may be omitted from the window assembly 1 such that the chamber 12 is sealed, thereby preventing the exchange of air between the chamber 12 and the surrounding exterior environment.

Figure 4A:
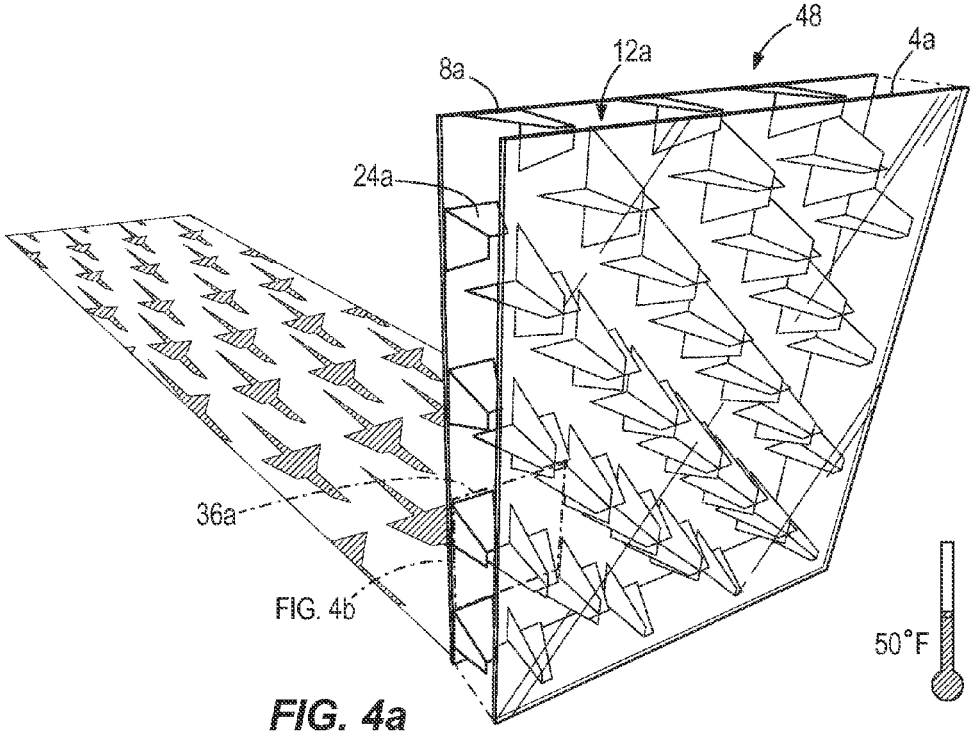
FIG. 4*a* is a perspective view of a window assembly in accordance with a second embodiment of the invention.
Figure 4B:
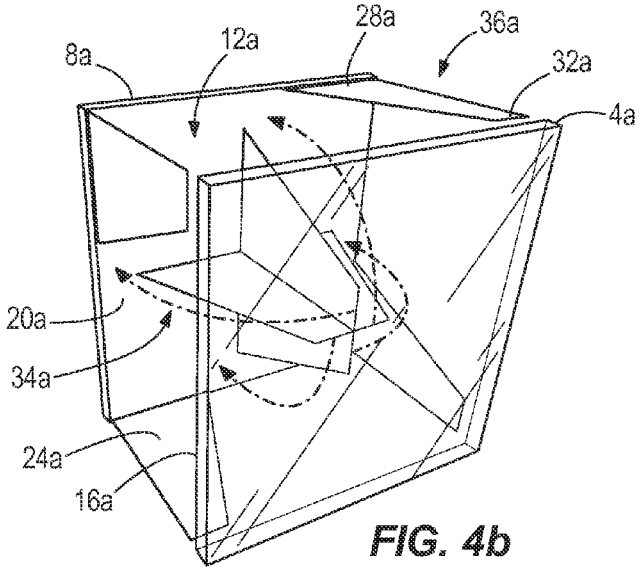
FIG. 4*b* is an enlarged view of the window assembly of FIG. 4*a*.
Figure 5A:
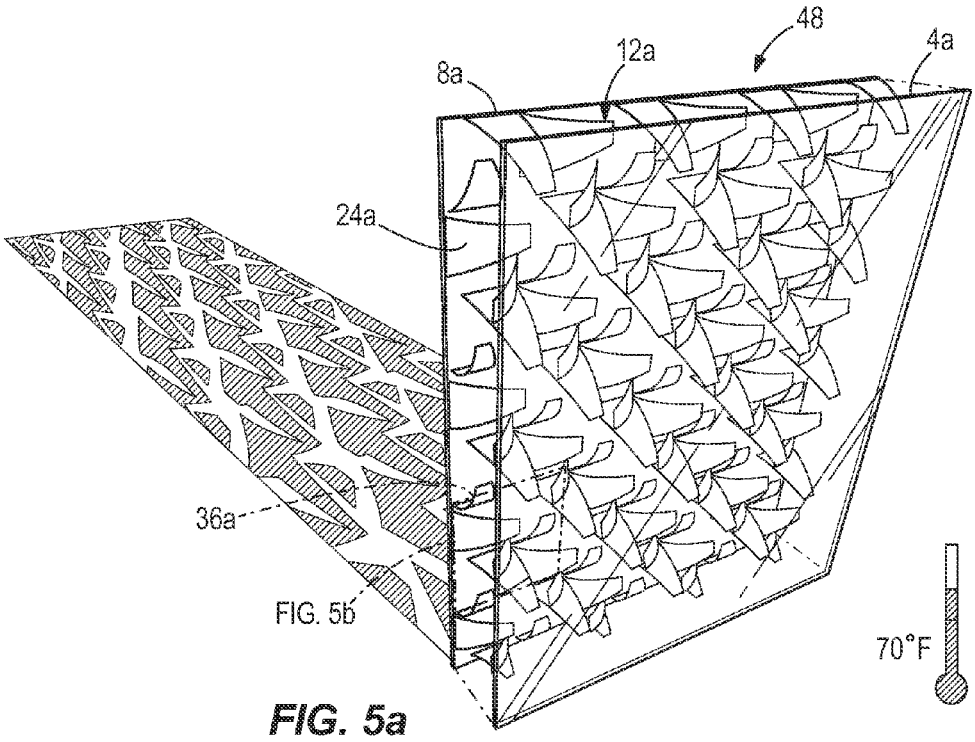
FIG. 5*a* is another perspective view of the window assembly of FIG. 4*a* exposed to a higher temperature.
Figure 5B:
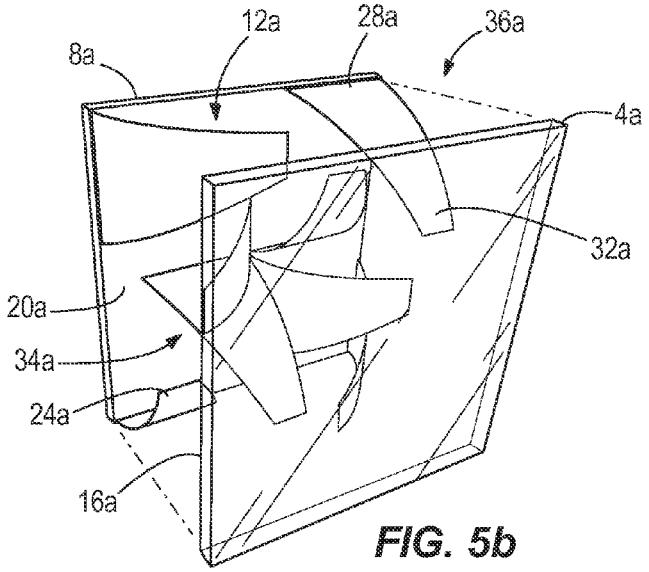
FIG. 5*b* is an enlarged view of window assembly of FIG. 5*a*.
Figure 6A:
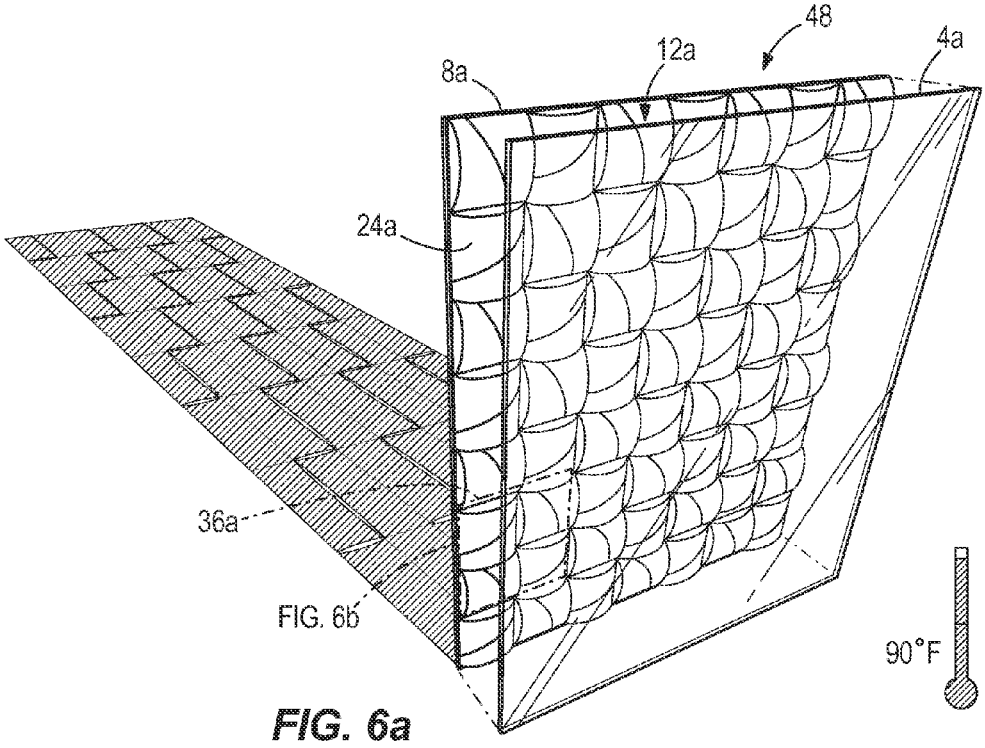
FIG. 6*a* is yet another perspective view of the window assembly of FIG. 4*a* exposed to a higher temperature.
Figure 6B:
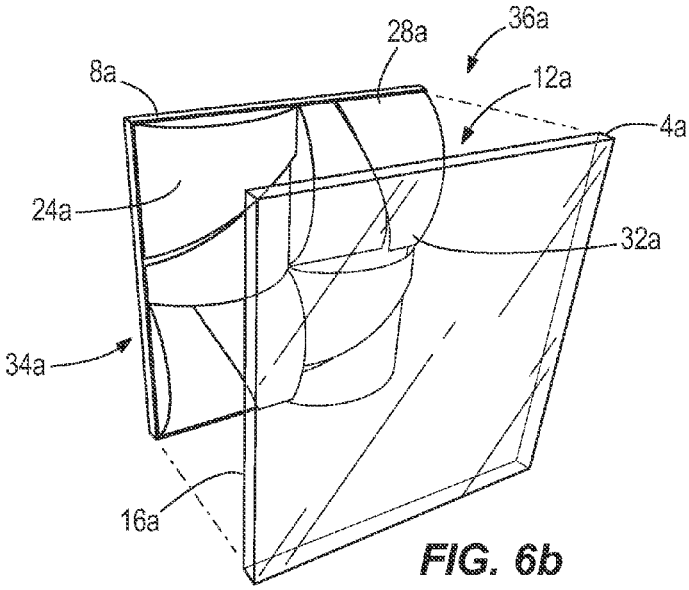
FIG. 6*b* is an enlarged view of the window assembly of FIG. 6*a*.

FIGS. 4*a*, 5*a*, and 6*a* illustrate a second construction of a window assembly 48 for use in a building (e.g., a commercial or residential building, etc.). Like components are identified with like reference numerals with the letter "a," and will not be described again in detail. Rather than the thermobimetal elements 24 having a rectangular shape like that shown in FIGS. 1*a*, 2*a*, and 3*a* and described above, the thermobimetal elements 24*a* have a trapezoidal (e.g., sail or wedge) shape as illustrated in FIGS. 4*a*, 5*a*, and 6*a*. The thermobimetal elements 24*a* are arranged in identical groups 34*a*, a first of the groups 34*a* being adjacent to a second of the groups 34*a* (FIGS. 4*b*, 5*b*, and 6*b*). The window assembly 48 operates in identical fashion as the window assembly 1 shown in FIGS. 1*a*, 2*a*, and 3*a* and described above.

Figure 7A:
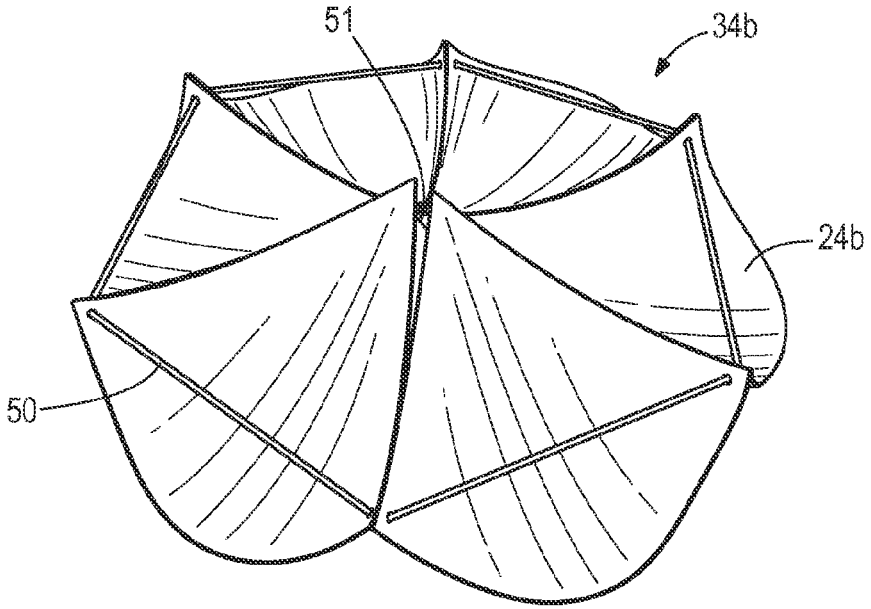
FIG. 7*a* is a perspective view of an alternative embodiment of the thermobimetal elements of the window assemblies of FIGS. 1*a* and 4*a*, in which the thermobimetal elements have assumed a second shape.
Figure 7B:
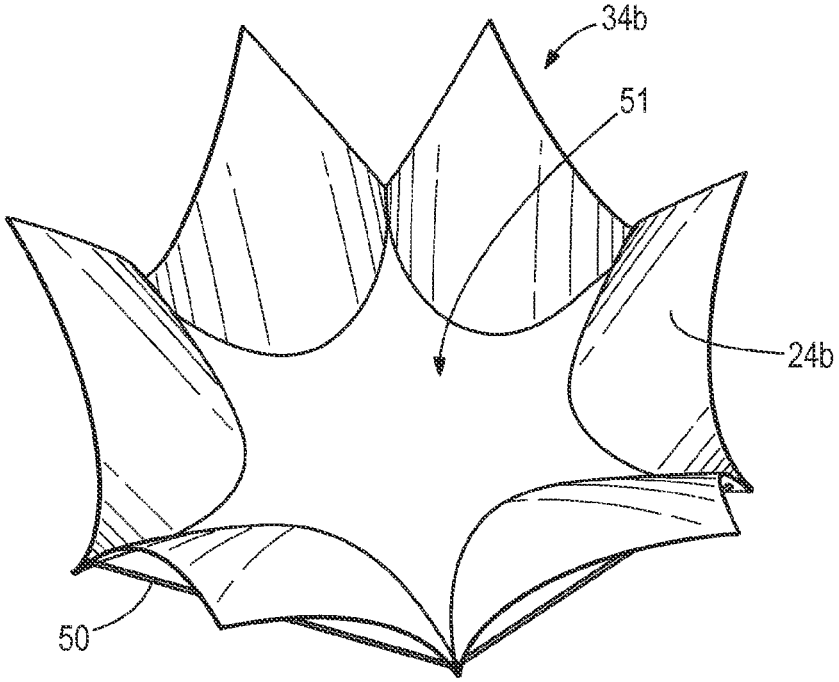
FIG. 7*b* is another perspective view of the thermobimetal elements of FIG. 7*a*, in which the thermobimetal elements have assumed a first shape.

FIGS. 7*a* and 7*b* illustrate an alternative embodiment of the thermobimetal elements for use in the window assembly. Like components are identified with like reference numerals with the letter "b," and will not be described again in detail. Rather than the thermobimetal elements 24, 24*a* having a rectangular or trapezoidal shape as described above, the thermobimetal elements 24*b* may have a diamond (e.g., kite) shape as illustrated in FIGS. 7*a* and 7*b*. As shown in FIG. 7*a*, the thermobimetal elements 24*b* are arranged in identical hexagonal clusters 34*b*, only one of which is shown. A coupling element 50 (e.g., a wire, a cable, and the like) may interconnect the thermobimetal elements 24*b* within the cluster 34*b*, thereby constraining or interconnecting the thermobimetal elements 24*b*. In some embodiments, the coupling element 50 may include a fixed length, while in other embodiments, the coupling element 50 may be made from a shape memory alloy (e.g., Nitinol) such that the length of the coupling element 50 is temperature dependent. In still other alternative embodiments, the coupling element may include a plurality of brackets, in which each bracket joins or connects adjacent thermobimetal elements 24*b*. The thermobimetal elements 24*b* may operate in an identical manner as the thermobimetal elements 24, 24*a* shown in FIGS. 1-6, namely transitioning between first and second shapes in response to changes in temperature. Each group or cluster 34*b* of thermobimetal elements 24*b* may further define an opening 51 in the center of the hexagonal cluster 34*b* when the thermobimetal elements 24*b* assume the first shape (FIG. 7*b*). The opening 51 is reduced in size when the thermobimetal elements 24*b* assume the second shape (FIG. 7*a*).

Figure 8B:
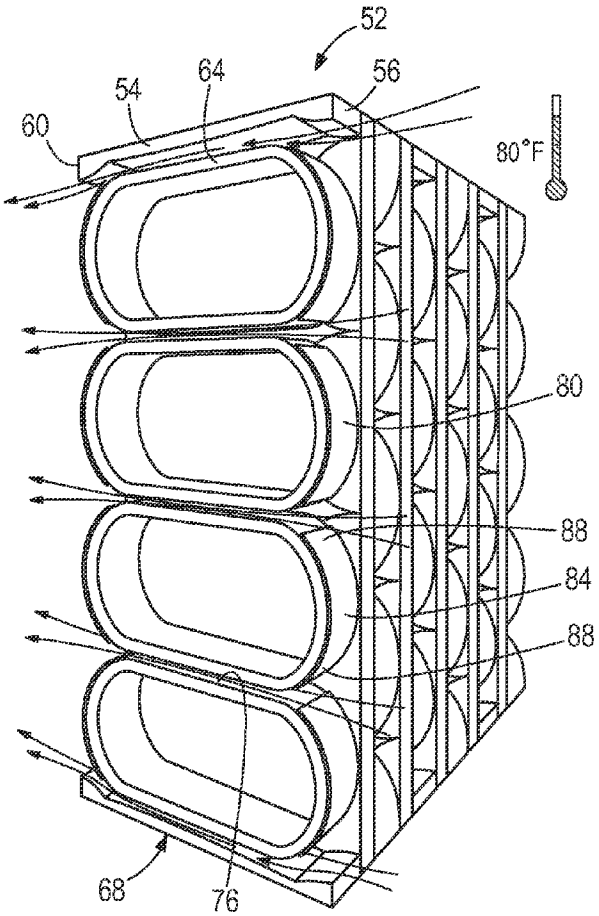
FIG. 8*b* is another perspective view of the construction module assembly of FIG. 8*a*.
Figure 8A:
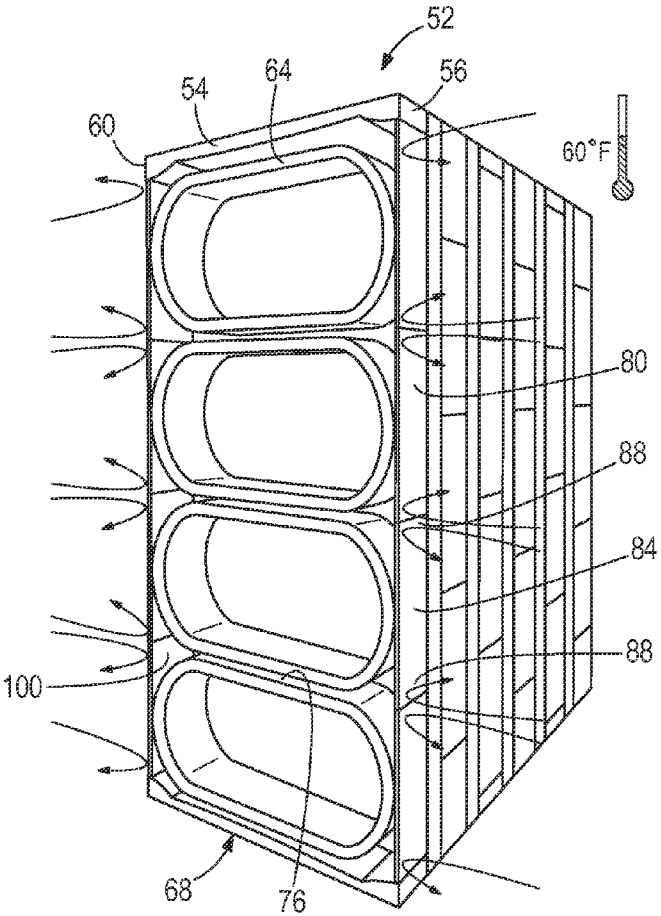
FIG. 8*a* is a perspective view of a construction module assembly in accordance with a first embodiment of the invention.

FIGS. 8*a* and 8*b* illustrate a first embodiment of a construction module assembly 52 for providing ventilation to a building (e.g., a commercial or residential building, etc.) in a temperature dependent manner. Multiple construction module assemblies 52 may be used together to form a larger structure(s) (e.g., walls) to provide ventilation to a space enclosed by the structure. The construction module assembly 52 includes a construction module 54 having first and second sides 56, 60 and multiple oblong portions 64 positioned in vertical rows 68 between the first and second sides 56, 60. The illustrated construction module assembly 52 has six vertical rows 68 in which the vertical rows 68 alternate between having four or five oblong portions 64 such that horizontally adjacent oblong portions 64 are shifted vertically relative to each other. In an alternative construction, the construction module assembly 52 may be configured having any number of vertical rows 68 with any number of oblong portions 64. Each oblong portion 64 has an enclosed, hollow space 72 (FIG. 9*a*), and in a vertical row 68 a first of the oblong portions 64 is positioned adjacent a second of the oblong portions 64 to define therebetween a passageway 76 that extends between the first and second sides 56, 60 of the construction module assembly 52 (FIGS. 8*a* and 8*b*).

Figure 9B:
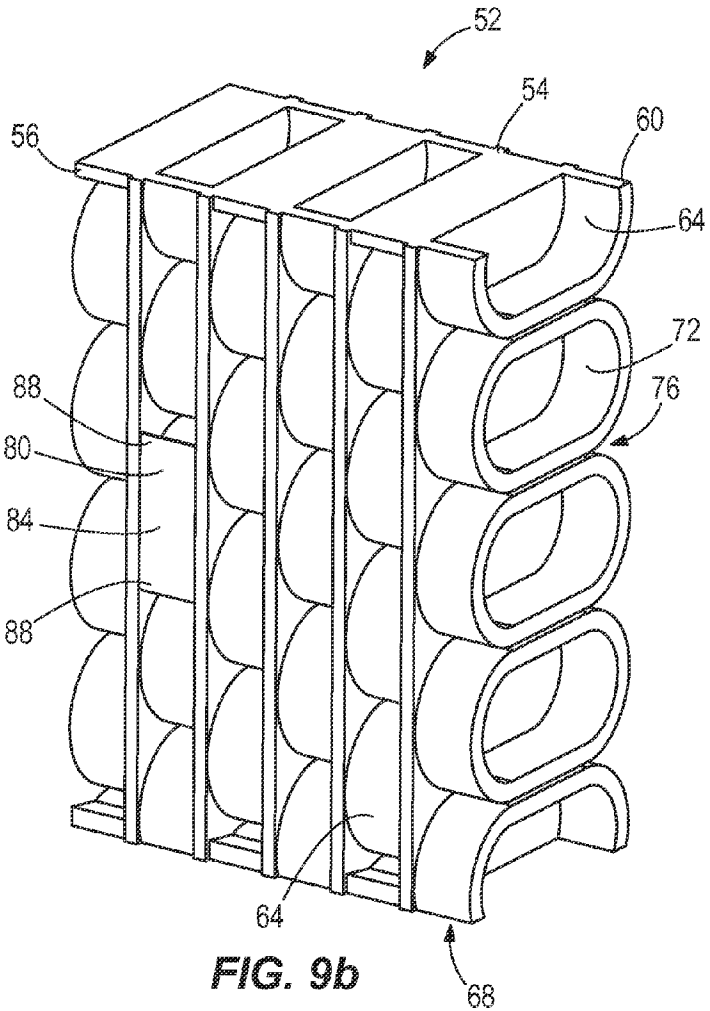
FIG. 9*b* is a perspective view of the construction module assembly of FIG. 8*a*, in which a single thermobimetal valve is shown.
Figure 9A:
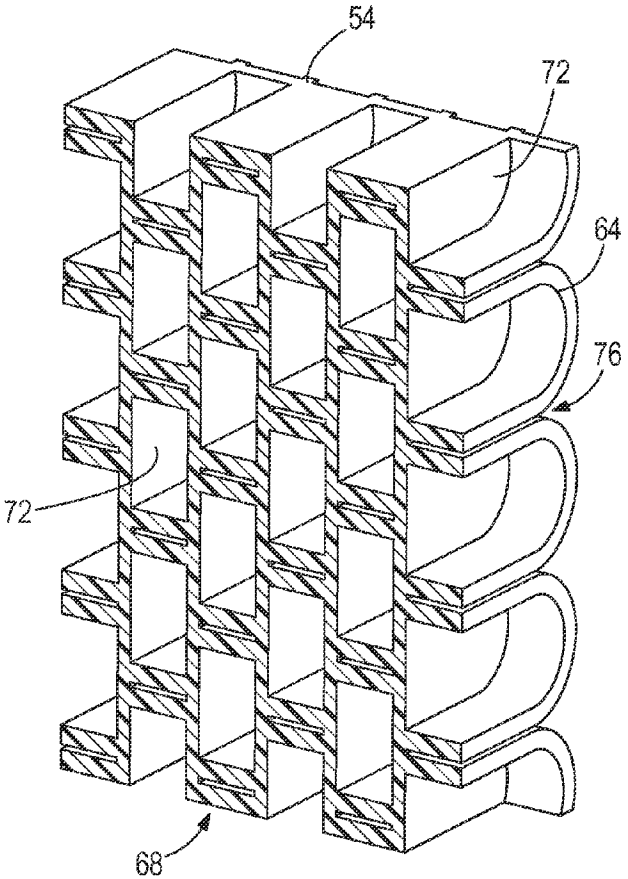
FIG. 9*a* is a cross-sectional view of the construction module assembly of FIG. 8*a*.

With continued reference to FIGS. 8*a* and 8*b*, the construction module assembly 52 also includes multiple thermobimetal valves 80 coupled to the first and second sides 56, 60 of the construction module assembly 52. Each thermobimetal valve 80 has a middle portion 84 coupled (e.g., by adhesion, fasteners, etc.) to a respective oblong portion 64 and opposite free ends 88 (FIG. 9*b*). Each thermobimetal valve 80 is made of a first sheet coupled (e.g., by lamination, adhesion, etc.) to a second sheet in which the first and second sheets include first and second metal alloys, respectively, in a similar manner as shown in FIG. 2*d*. The first and second metal alloys have different coefficients of thermal expansion and as such, the first and second sheets expand at different rates as heat is applied to the thermobimetal valve 80, causing each thermobimetal valve 80 to transition (e.g., curl) from a first shape (FIG. 8*a*) to a second shape (FIG. 8*b*). In turn, as heat is removed from the thermobimetal valve 80, the valve 80 transitions from the second shape to the first shape. In the first shape, the thermobimetal valve 80 is straight and the opposite free ends 88 of the thermobimetal valve 80 are oriented parallel to the first and second sides 56, 60 of the construction module assembly 52 (FIG. 8*a*). In the second shape, the thermobimetal valve 80 has an arcuate shape and follows the contour of the respective oblong portion 64 (FIG. 8*b*). As the thermobimetal valves 80 transition between the first and second shapes, the passageways 76 are blocked by the free ends 88 of the thermobimetal valves 80, inhibiting airflow through the passageways 76 (FIG. 8*a*) or are open, permitting air flow through the passageways 76 (FIG. 8*b*), respectively.

The thermobimetal valves 80 may optionally be coated with a desiccant (e.g., silica gel) to enhance or increase the temperature differential measured between opposite sides of each of the valves 80 when used in a humid environment. Particularly, silica gel releases heat when it absorbs moisture, with the released heat causing the valves 80 to curl or transition from the first shape to the second shape as described above, even in the absence of direct sunlight. Should the silica gel become at least partially or fully saturated, it may be dried by exposure to direct sunlight (thereby heating the silica gel to a temperature of about 160 degrees Fahrenheit) for subsequent reuse in absorbing moisture and releasing heat. When the silica gel absorbs moisture and thus releases heat, the heat is applied to the thermobimetal valve 80, causing each thermobimetal valve 80 to transition from the first shape (FIG. 8*a*) to the second shape (FIG. 8*b*) to open the passageways 76 and permit air flow through the passageways 76. Conversely, in the presence of low humidity, the valve 80 transitions from the second shape to the first shape to block the passageways 76, inhibiting airflow through the passageways 76.

With reference to FIGS. 8*a* and 8*b*, on the first side 56 of the construction module assembly 52, a first and a second of the thermobimetal valves 80 are attached via respective middle portions 84 to the first and second oblong portions 64, respectively (e.g., by adhesion, using fasteners, etc.). One free end 88 of each of the first and second thermobimetal valves 80 are located adjacent each other and the passageway 76. On the second side 60 of the construction module assembly 52, a third and a fourth of the thermobimetal valves 80 are attached via respective middle portions 84 to the first and second oblong portions 64, respectively (e.g., by adhesion, using fasteners, etc.). One free end 88 of each of the third and fourth thermobimetal valves 80 are positioned adjacent each other and the passageway 76. When the first, second, third, and fourth thermobimetal valves 80 assume the first shape (i.e., straight), the adjacent free ends 88 of the first and second thermobimetal valves 80 are in close proximity, blocking the passageway 76 on the first side 56 of the construction module assembly 52 (FIG. 8*a*). Likewise, the adjacent free ends 88 of the third and fourth thermobimetal valves 80 are in close proximity, blocking the passageway 76 on the second side 60 of the construction module assembly 52. As such, the blocked passageway 76 becomes a sealed air pocket 100 which cannot exchange air with the exterior surroundings of the construction module assembly 52, effectively increasing the insulation factor of the module assembly 52. When the first, second, third, and fourth thermobimetal valves 80 assume the second shape (i.e., arcuate), the thermobimetal valves 80 follow the contour of the respective oblong portions 64 and the free ends 88 are no longer in close proximity, opening the passageway 76 and permitting airflow through the passageway 76 (FIG. 8*b*) to facilitate the exchange of air between the first and second sides 56, 60 of the construction module assembly 52.

With continued reference to FIGS. 8*a* and 8*b*, the construction module assembly 52 is operable to provide ventilation to a space without requiring human interaction or an electronic control system. During periods of lower temperatures (e.g., 60 degrees Fahrenheit, FIG. 8*a*) or humidity (i.e., when the valves 80 are coated with a desiccant), the thermobimetal valves 80 assume the first shape (i.e., straight) and the opposite free ends 88 of the thermobimetal valves 80 are in close proximity to block the passageways 76. As such, air is prevented from moving between the first and second sides 56, 60 of the construction module assembly 52, thereby re-purposing the passageways 76 as sealed air pockets 100. The sealed air pockets 100 effectively increase the insulation factor of the construction module assembly 52. During periods of higher temperatures (e.g., 80 degrees Fahrenheit, FIG. 8*b*) or humidity (i.e., when the valves 80 are coated with a desiccant), the thermobimetal valves 80 assume the second shape (i.e., arcuate) and follow the contours of the respective oblong portions 64 to open the passageways 76. The open passageways 76 permit air to move between the first and second sides 56, 60 of the construction module assembly 52 and thus ventilation is provided to the space, reducing the need for artificial cooling and the attendant energy consumption for cooling a building made from the construction module assemblies 52 as compared to conventional construction materials.

Figure 10B:
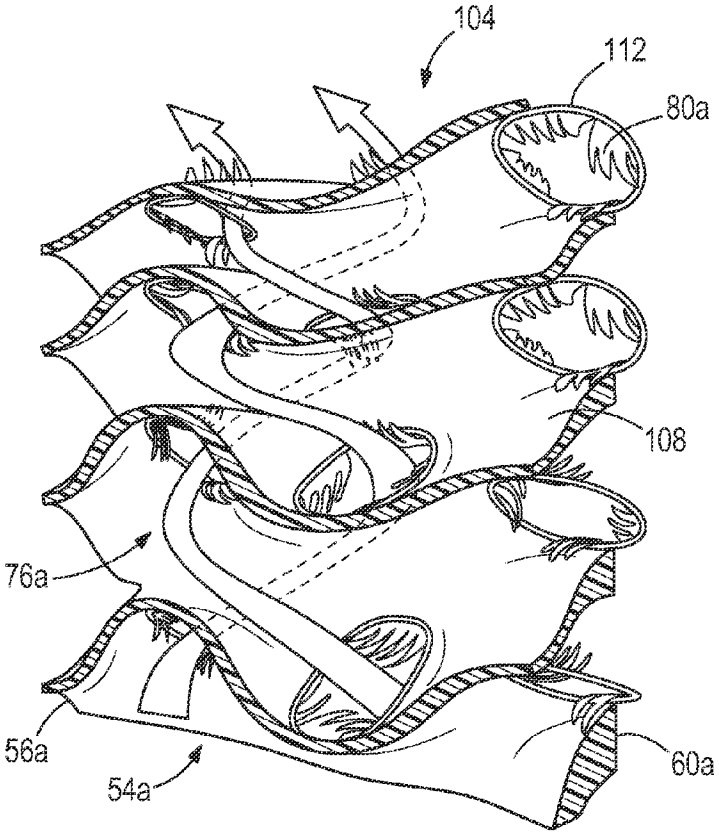
FIG. 10*b* is another cross-sectional view of the construction module assembly of FIG. 10*a*.
Figure 10A:
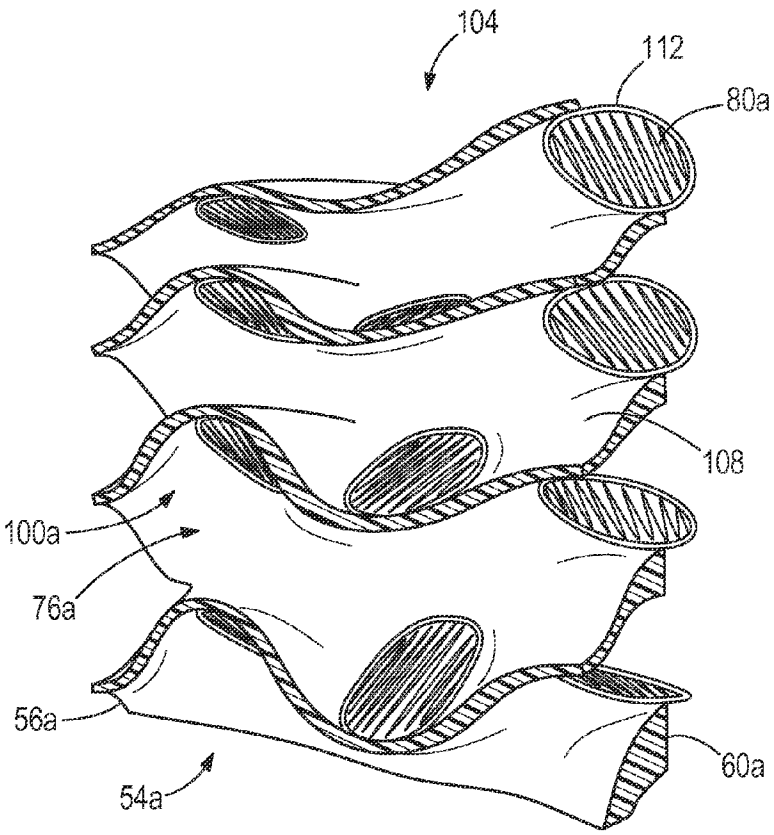
FIG. 10*a* a cross-sectional view of a construction module assembly in accordance with a second embodiment of the invention.

FIGS. 10*a* and 10*b* illustrate a second embodiment of a construction module assembly 104 for providing ventilation to a building (e.g., a commercial or residential building, etc.) in a temperature dependent manner. Like components are identified with like reference numerals with the letter "a," and will not be described again in detail. Rather than multiple oblong portions 64 being positioned between the first and second sides 56, 60 of the construction module 54, a continuous surface (e.g., gyroid surface) having multiple vertically spaced folds 108 is located between the first and second sides 56*a*, 60*a* of the module 54*a*. In the illustrated embodiment, four folds 108 are vertically positioned or stacked such that a first of the folds 108 is adjacent a second of the folds 108 to define therebetween a passageway 76*a*. The passageway 76*a* is further defined by a third fold 108 located adjacent the second fold 108, and a fourth fold 108 located adjacent the third fold 108. In an alternative embodiment, the construction module assembly 104 may be configured having any number of folds 108 positioned in any number of orientations relative to one another.

The construction module assembly 104 also includes multiple ventilation ports 112 within each of the folds 108. As shown in FIGS. 10*a* and 10*b*, the ports 112 are misaligned, thereby requiring a rising airflow (FIG. 10*b*) to take a circuitous path when moving between the layers 108. Accordingly, the rising airflow also moves side to side within the module 54*a* in order to traverse the circuitous path. Each port 112 has multiple thermobimetal valves 80*a* associated therewith that are in close proximity or comingle when the valves 80*a* assume the first shape, thereby blocking airflow through the individual ports 112 and therefore the passageway 76*a* (FIG. 10*a*). As such, multiple sealed air pockets 100*a* are formed between the folds 108. When the thermobimetal valves 80*a* assume the second shape, the valves 80*a* in the respective ports 112 are separated and permit airflow through the individual ports 112 and therefore the passageway 76*a* (FIG. 10*b*). Accordingly, the construction module assembly 104 operates in a similar manner as the construction module assembly shown in FIGS. 8*a* and 8*b*.

Various features of the invention are set forth in the following claims.

What is claimed is:

1. A window assembly comprising:

a pane of material through which light is passable; and a plurality of thermobimetal elements positioned adjacent the pane, the elements each assuming a first shape at a first temperature and a second shape at a second temperature;

wherein the elements reflect more light away from the pane when in the second shape than the first shape.

2. The window assembly of claim 1, wherein a reduced amount of light is passable through the pane when the elements assume the second shape.

3. The window assembly of claim 1, wherein at least some of the elements are oriented substantially normal to the pane when in the first shape.

4. The window assembly of claim 1, wherein the elements are substantially straight when in the first shape.

5. The window assembly of claim 1, wherein the elements are arcuate when in the second shape.

6. The window assembly of claim 1, wherein the pane is a first pane, wherein the window assembly further includes a second pane of material through which light is passable, and wherein the elements are positioned between the first and second panes.

7. The window assembly of claim 6, wherein the elements are attached to the second pane.

8. The window assembly of claim 7, wherein each of the elements includes a first end and a second end, wherein the first ends of the respective elements are attached to the second pane, and wherein the second ends of the respective elements are not attached to either the first pane or the second pane.

9. The window assembly of claim 8, wherein the first ends of the respective elements are constrained when the elements transition from the first shape to the second shape, and wherein the second ends of the respective elements are movable relative to the first and second panes when the elements transition from the first shape to the second shape.

10. The window assembly of claim 6, further comprising:

a frame to which the first and second panes are mounted, thereby defining a chamber in which the elements are positioned; and a thermobimetal valve coupled to the frame and assuming a first shape, in which air is permitted to enter and exit the chamber, and a second shape, in which air is prevented from entering and exiting the chamber.

11. The window assembly of claim 1, wherein the plurality of thermobimetal elements is a first plurality of thermobimetal elements arranged in a first group, and wherein the window assembly further includes a second plurality of thermobimetal elements arranged in a second group substantially identical to the first group.

12. The window assembly of claim 11, wherein the first group of thermobimetal elements is positioned adjacent the second group of thermobimetal elements.

13. The window assembly of claim 11, wherein the first group of thermobimetal elements is associated with a first region of the pane, and wherein the second group of thermobimetal elements is associated with a second region of the pane.

14. The window assembly of claim 11, wherein the thermobimetal elements of the first group are arranged to define a hexagonal cluster.

15. The window assembly of claim 14, wherein the thermobimetal elements define an opening in a center of the hexagonal cluster when the thermobimetal elements assume the first shape.

16. The window assembly of claim 15, wherein the opening is reduced in size when the thermobimetal elements assume the second shape.

17. The window assembly of claim 14, further comprising a coupling element interconnecting the first group of thermobimetal elements.

18. The window assembly of claim 1, wherein the assembly is substantially transparent when the elements assume the first shape, and wherein the assembly is substantially opaque when the elements assume the second shape.

19. The window assembly of claim 1, wherein each of the thermobimetal elements includes a first sheet of a first metal alloy and a second sheet of a second metal alloy coupled to the first sheet.

20. The window assembly of claim 19, wherein the second metal alloy includes a coefficient of thermal expansion different than a coefficient of thermal expansion of the first metal alloy.

* * * * *